United States Patent [19]

Nakamura et al.

[11] Patent Number: 4,681,465

[45] Date of Patent: Jul. 21, 1987

[54] ALARM SIGNALLING ELECTRONIC TIMEPIECE WITH TIMER FUNCTION

[75] Inventors: Norihiko Nakamura, Tokyo; Hideki Morishima, Yokohama; Yoshito Yamaguchi, Saitama, all of Japan

[73] Assignee: Rhythm Watch Co. Ltd., Tokyo, Japan

[21] Appl. No.: 611,891

[22] Filed: May 18, 1984

[30] Foreign Application Priority Data

May 23, 1983 [JP] Japan ..... 58-90994
May 25, 1983 [JP] Japan ..... 58-93206

[51] Int. Cl.[4] ..... G04B 23/10

[52] U.S. Cl. ..... 368/246; 368/74; 368/245; 368/250; 368/261

[58] Field of Search ..... 368/246, 248, 261, 262, 368/263, 72, 73, 74

[56] References Cited

U.S. PATENT DOCUMENTS 3,733,802 5/1973 Wisser ..... 368/248
3,834,153 9/1974 Yoda et al. ..... 368/251
4,178,750 12/1979 Murakami et al. ..... 368/56
4,301,524 11/1981 Koepp et al. ..... 368/251
4,379,641 4/1983 Maezawa ..... 368/261
4,405,241 9/1983 Aihara et al. ..... 368/251

*Primary Examiner*—Bernard Roskoski
*Attorney, Agent, or Firm*—Koda and Androlia

[57] ABSTRACT

An alarm signalling electronic timepiece including an alarm signalling circuit which generates alarm signal at a preset hour, and a sound circuit which generates signalling sound by the alarm signal. This timepiece includes a timer counter which can memorize and subtract preset time and which can supply the alarm signal to the sound circuit after the set time elapses from the start of down count from a a time start circuit which holds the time memorized in said timer counter until the alarm signal from the alarm signalling circuit changes and which starts counting in said timer counter when the alarm signal changes, and external switches which externally switch over to work or cancel said time start circuit, whereby plural and different alarm signalling hours can be set with more simplicity.

3 Claims, 8 Drawing Figures

ALARM SIGNALLING ELECTRONIC TIMEPIECE WITH TIMER FUNCTION

BACKGROUND OF THE INVENTION

1. Field of The Invention

This invention relates to an alarm signalling electronic timepiece with a timer function which generates another signalling sound after a preset time elapses since the alarm signalling sound is previously generated or stopped.

2. Description of The Prior Art

The alarm signalling function of the alarm signalling electronic timepiece has been of the best use for a wake-up signal. The alarm signalling electronic timepiece is not only used by plural persons who must wake up at the same time but also commonly used among plural persons who must wake up individually at their individual hours. In the prior device of the alarm signalling electronic timepiece, however, an alarm signalling time can be set once, and the next alarm signalling hour must be set again after the previous alarm signal is functioned. Such operation is troublesome and it is really impossible to perform such kind of operations.

In consideration of such prior art device, a multi-alarm signalling electronic timepiece has been offered with a such purpose that plural and different alarm signalling hours can be set respectively. In ordinary cases, however, a time is considered, that is, some minutes after the previous set hour, some minutes after a previous person wakes up or the like, when a user sets alarm signalling hours on the multi-alarm signalling electronic timepiece. In this kind of multi-alarm signalling electronic timepiece of the prior art device which can be set the alarm signalling time by the hour, the user must convert the time into the hour to set the individual alarm signalling times.

As mentioned above, it is troublesome to set the individual times on the alarm signalling electronic timepiece for the individual people who wales up at the different hours, and the improvement has been requested.

SUMMARY OF THE INVENTION

Accordingly, it is a general object of the present invention to provide an alarm signalling electronic timepiece with a timer function by which plural and different alarm signalling hours can be set with more simplicity.

In keeping with the principles of the present invention, the object is accomplished with an alarm signalling electronic timepiece with a timer function of the type which includes an alarm signalling circuit which generates alarm signal at a preset hour, and a sound circuit which generates signalling sound by the alarm signal The alarm signalling electronic timepiece with a timer function includes a timer counter which can memorize and down count from the preset time and which can supply the alarm signal to the sound circuit after the set time elapses from the start of down counting, a time start circuit which holds the time memorized in the time counter until the alarm signal from the alarm signalling circuit changes and which starts counting in the timer counter when the alarm signal changes, and external switches which externally switch over to work or cancel the time starts circuit.

DETAILED DESCRIPTION OF THE EMBODIMENTS

Referring more particularly to the drawings, the embodiments of the present invention will be hereinafter described.

The First Embodiment

Figure 1:
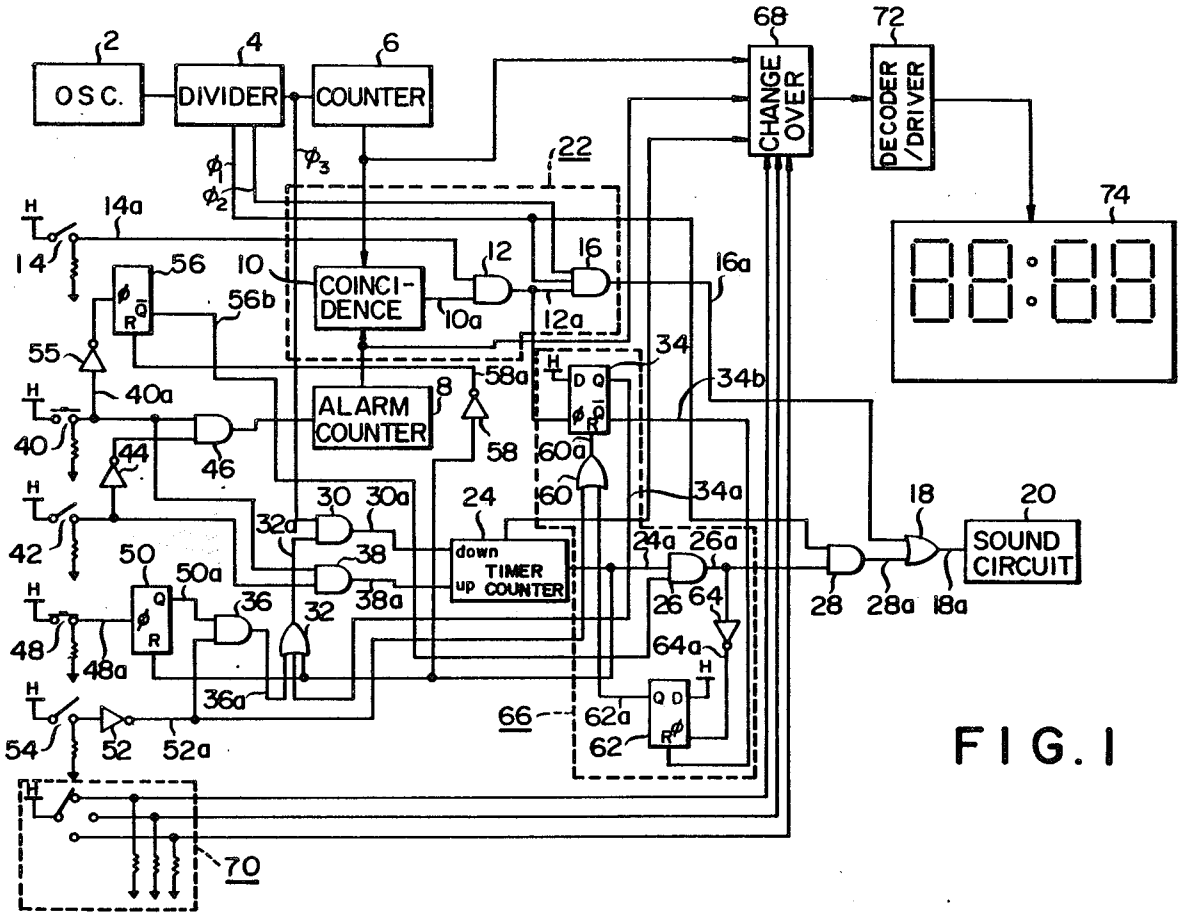
FIG. 1 is a circuit diagram in accordance with the teachings of the first embodiment.

FIG. 1 is a circuit diagram showing an embodiment of the present invention.

In FIG. 1 a standard signal generator 2 and a divider 4 output hour counting standard signal to a timing counter 6 to count the preset hour. The present hour signal at the timing counter 6 is compared at an identity circuit 10 with alarming hour signal in an alarming hour counter 8 in which the alarm set hour is memorized, and identity signal 10*a* is output to an AND gate 12, if identified. The AND gate 12 is supplied sound stop signal 14*a* from a sound stop switch 14 and provides output signal to an AND gate 16. This AND gate 16 is supplied audio frequency signal $\phi_1$ and fixed periodic signal $\phi_2$ from the divider 4, and the output signal is supplied to a sound circuit 20 by way of an OR gate 18. An alarm signalling circuit 22 consists of the identity circuit 10 and the AND gates 12 and 16 to generate alarm signal at a preset hour.

Figure 2:
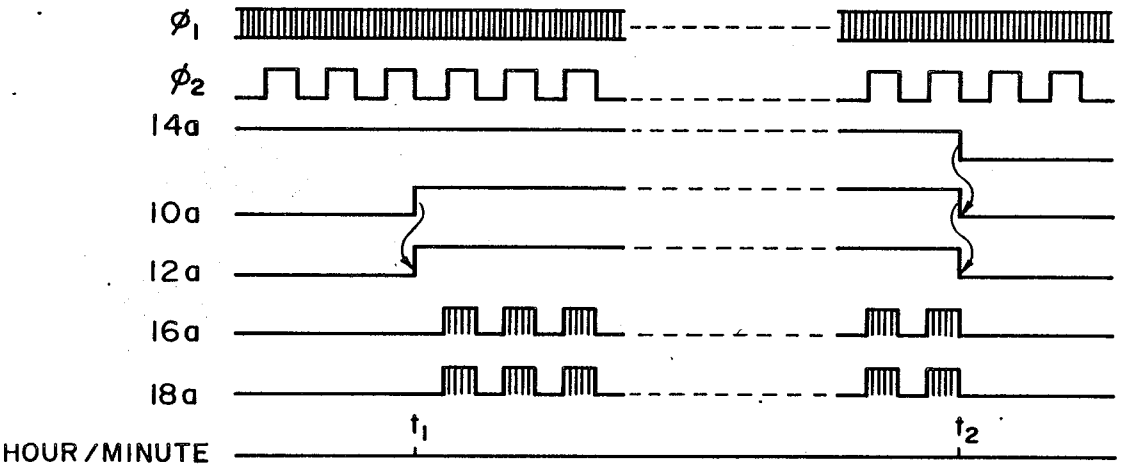
FIG. 2 is a timing chart of alarm signalling action in the circuit of FIG. 1.

FIG. 2 is a timing chart showing the action at alarm signalling time.

When the sound stop switch 14 is closed and it becomes alarm signal set hour (hour $t_1$) in the state that the sound stop signal 14*a* is H, the identity signal 10*a* rises up from L to H and the output signal 12*a* of the AND gate 12 also becomes H. Accordingly, in the output signal 16*a* from the AND gate 16 generated therein is intermittent sound signal which is superimposed the signals $\phi_1$ and $\phi_2$ thereon, and the sound signal is supplied to the sound circuit 20 by way of the OR gate 18 so that the sound circuit 20 can generate intermittent sound as the alarm signal.

Afterwards, at the hour $t_2$ when the sound stop circuit 14 is opened, the sound stop signal 14*a* becomes L to have the AND gates 12 and 16 to be closed and their output signals 12*a* and 16*a* and the output signal 18*a* of the OR gate 18 become L so that the signal sound is stopped being generated from the sound circuit 20.

A timer counter 24 which memorizes the set time and starts down counting when it becomes the alarm set hour consists of a up and down counter which can add and subtract. The output signal 24*a* from the timer counter 24 is provided to an AND gate 26, and the output signal 26*a* is supplied to an AND gate 28. To this AND gate 28 input is the audio frequency signal $\phi_1$ mentioned previously, and its output signal 28*a* is supplied to the sound circuit 20 by way of the OR gate 18. To the down input of the timer counter 24 provided is the output signal 30*a* from an AND gate 30, and to this AND gate 30 supplied are the fixed periodic signal $\phi_3$ and the output signal 32*a* from an OR gate 32. To this OR gate 32 input are the output 24*a* from the timer counter 24, the Q output 34*a* of an FF 34 and the output 36*a* from the AND gate 36 which will be hereinafter described of.

On the other hand, to the up input of the timer counter 24 supplied is the output 38*a* of an AND gate 38 and to this AND gate 38 provided are correction signal 40*a* of a correction switch 40 and correction change over signal 42*a* from a correction change over switch 42. These correction signal 40*a* and correction change over signal 42*a* by way of an inverter 44 are also supplied to an AND gate 46, and the output of the AND gate 46 is provided to the alarming hour counter 8. Therefore, when the correction change over switch 42 is opened and the correction switch 40 is operated, the correction signal 40*a* is supplied to the alarming hour counter 8, and, when the correction change over switch 42 is closed and the correction switch 40 is operated, the correction signal 40*a* is provided to the timer counter 24.

Timer action signal 48*a* of a timer switch 48 which makes the timer action started or stopped is supplied to the clock input $\phi$ of an FF 50, and the Q output 50*a* of the FF 50 is provided to the one input of the AND gate 36 previously described. To this AND gate 36 input is timer control signal 54*a* of the time control switch 54 by way of an inverter 52. Furthermore, in this embodiment, the correction switch 40 mentioned above is functioned as a timer sound stop switch and thecorrection signal 40*a* is supplied to the clock input $\phi$ of an FF 56 by way of the inverter 55. The $\overline{Q}$ output 56*b* of the FF 56 is provided to one input of the AND gate 26. The output 24*a* from the timer counter 24 is supplied to the reset input R of the FF 56 by way of an inverter 58.

Figure 3:
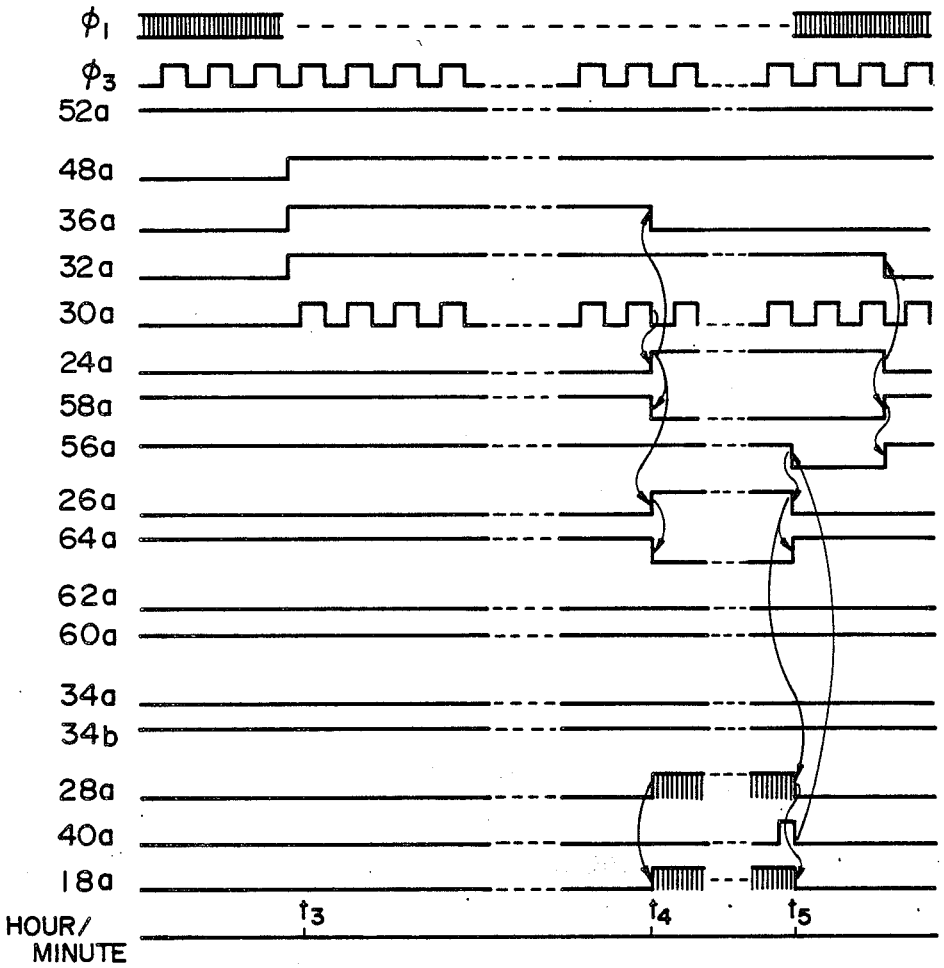
FIG. 3 is a timing chart of timer action in the circuit of FIG. 1.

FIG. 3 is a timing chart showing the timer action in the circuit of FIG. 1.

At the hour $t_3$ in the state that the set time is memorized in the timer counter 24, the operation of the timer switch 48 makes the timer action signal 48*a* rise up from L to H and the Q output 50*a* of the FF 50 become H. In this state, when the timer control switch 54 is open, the timer control signal 52*a* becomes H, and the output 36*a* of the AND gate 36 also becomes H. The signal of H opens the AND gate 30 so that the fixed periodic signal $\phi_3$ is supplied from the divider 4 to the down input of the timer counter 24. therefore, the timer counter 24 starts down counting from the set time.

When the set time elapses since then (hour $t_4$), the output 24*a* of the timer counter 24 rises up from L to H, and the output 26*a* of the AND gate 26 becomes H. To the output 28*a* of the AND gate 28 provided is the audio frequency signal $\phi_1$ from the divider 4 and this signal is supplied to the sound circuit 20. Consequently, the sound circuit 20 generates the continuous signalling sound which is different from the alarm signalling sound. On the other hand, when the output 24*a* of the timer counter 24 rises up from L to H, the reset state of the FF 56 is released, and the operation of the correction switch 40 at the hour $t_5$ after the signalling sound is generated makes the $\overline{Q}$ output 56*b* of the FF 56 become L and the output 26*a* of the AND gate 26 turn into L. Accordingly, the audio frequency signal $\phi_1$ is not supplied to the sound circuit 20 so that the signalling sound can be stopped.

Afterwards, at the hour $t_6$ when the output 24*a* of the timer counter 24 rises down from H to L, the FF 56 is reset and the output 56*b* becomes H.

As mentioned previously, the operation of the timer switch 48 starts the timer operation and the signalling sound is generated at the set time. When the timer switch 48 is again operated during the timer in action, the Q output 50*a* of the FF 50 is inverted into L and the AND gates 36 and 30 are closed so that the timer counter 24 stops its down counting action.

On the other hand, the timer control signal 52*a* is supplied to the reset input R of the FF 34 by way of an OR gate 60. To the clock input $\phi$ provided is the output 12*a* of the AND gate 12 in the alarm signalling circuit 22. The $\overline{Q}$ output 34*b* of the FF 34 is supplied to the reset input R of an FF 62. The clock input $\phi$ of this FF 62 receives the output 26*a* of the AND gate 26 by way of an inverter 64. The Q output 62*a* of the FF 62 is supplied to the reset input R of the FF 34 by way of the OR gate 60.

These FF 34 and 62, the OR gate 60 and the inverter 64 compose a timer start circuit 66 which activates the above mentioned timer counter 24 at the hour of alarm signalling by the operation of the timer control switch 54.

Furthermore, the present hour signal from the timing counter 6, the alarming hour signal from the alarming hour counter 8 and the timer hour signal from the timer counter 24 are supplied to a display change over circuit 68. This display change over circuit 68 selects either one of the hour signals supplied by the operation of a display change over switch 70 and provides this to an hour display section 74 by way of a decoder driver 72.

Figure 4:
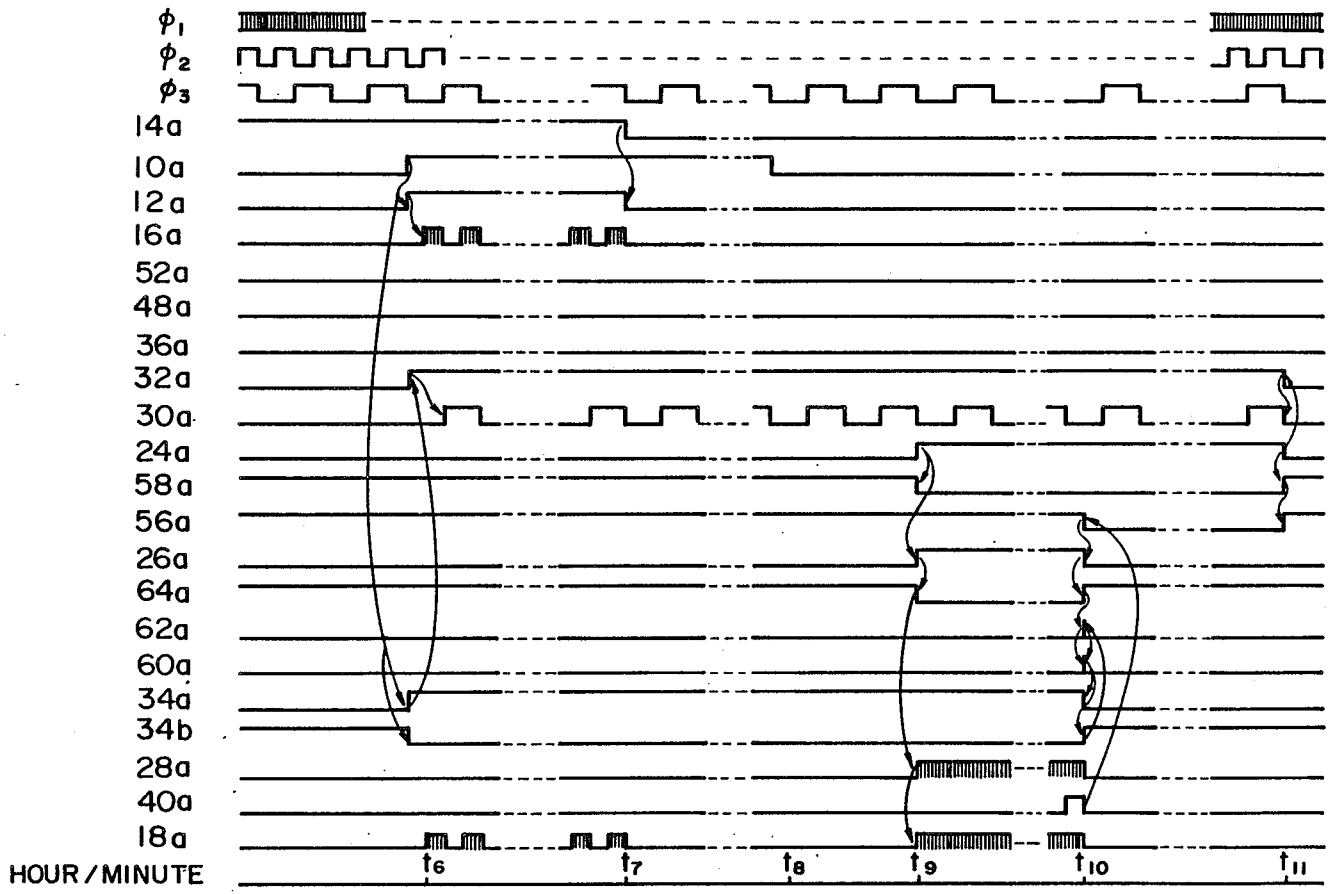
FIG. 4 is a timing chart of the action at the time of timer start in FIG. 1 after the alarm signalling time.

FIG. 4 is a timing chart showing the case that the timer is activated immediately after the alarm signalling, and the signalling sound is generated after the set time elapses.

In this state, both of the timer control switch 54 and the sound stop switch 14 are closed. The timer control signal 52*a* is L and the sound stop signal 14*a* is H.

Right here, at the hour $t_6$, the identity signal 10*a* becomes H, and the output 12*a* of the AND gate 12 rises up from L to H. Accordingly, the intermittent sound signal is generated in the output 16*a* of the AND gate 16, and the intermittent signalling sound is generated.

At the same time the output 12*a* rises up from L to H, the Q output 34*a* of the FF 34 becomes H and the output 34*b* becomes L. Therefore, since the reset state of the FF 62 is released and the H state of the output 32*a* of the OR gate 32 opens the AND gate 30, the fixed periodic signal $\phi_3$ is supplied to the down input of the timer counter 24 to start down counting the set time.

As mentioned above the timer start its action at the same time of alarm signalling.

Afterwards, at the hour $t_7$ when the sound stop switch 14 is opened and the sound stop signal 14*a* becomes L, both of the output 12*a* of the AND gate 12 and the output 16*a* of the AND gate 16 become L, and the alarm signalling sound stops. Furthermore, at the hour $t_8$ the identity signal 10*a* also changes from H into L.

When it becomes the hour $t_9$ after the set time elapses from the hour $t_6$, the output 24*a* of the timer counter 24 rises up from L to H. Therefore, the output 26*a* of the AND gate 26 becomes H, and the audio frequency signal $\phi_3$ is generated in the output 28*a* of the AND gate 28. Accordingly, the timer signalling sound is generated from the sound circuit 20.

At the hour $t_{10}$, the operation of the correction switch 40 changes the $\overline{Q}$ output 56*b* of the FF 56 from H to L and the output 26*a* of the AND gate 28 from H to L. Therefore, the output 28*a* of the AND gate 28 also becomes L, and the timer signalling sound stops.

At the same time, the clock input $\phi$ of the FF 62 receives the rising signal, and the Q output 62*a* of the FF 62 becomes H. Therefore, the output 60*a* of the OR gate 60 becomes H to reset the FF 34. The Q output 34*a* becomes L, and the Q output 34*b* becomes H. Accordingly, the FF 62 can be reset.

Furthermore, at the hour $t_{11}$, the output 24*a* of the timer counter 24 changes from H to L, and the output 32*a* of the OR gate 32 becomes L. The AND gate 30 is closed at this time, and the down counting action of the timer counter 24 stops. At the same time, the FF 56 is reset and the $\overline{Q}$ output 56*a* again becomes H.

As mentioned above, when the timer control switch 54 is closed, the timer can be started at the alarm signalling hour, and the timer signalling sound can be generated after the set time elapses. Therefore, when the clock in accordance with this embodiment is used as common alarm clock for the persons who wake up at the different hours, it becomes easier to set the other later times, since the users do not have to convert into the hour from whether the later set hour becomes so many minutes later, but can set this later time as the time is.

It is also possible in this embodiment to activate either one of the alarm signalling or the timer function.

As described heretofore, according to the present invention, the start of the timer action generating the signalling sound after the set time at the same time of alarm signalling enables the signalling sound to be again generated at the set time after the alarm signalling. Therefore, with regard to the case that the later signalling hour can be easily thought on the basis of time such as so many minutes after the previous signalled hour, it becomes much easier to use a wake-up alarm among the persons who wakes up at different hours than the multi-alarm signalling electronic timepiece which must be set on the basis of nothing but the hour, and the alarm signalling electronic timepiece with the timer function can be offered for the production of other various new uses.

Second Embodiment

Figure 5:
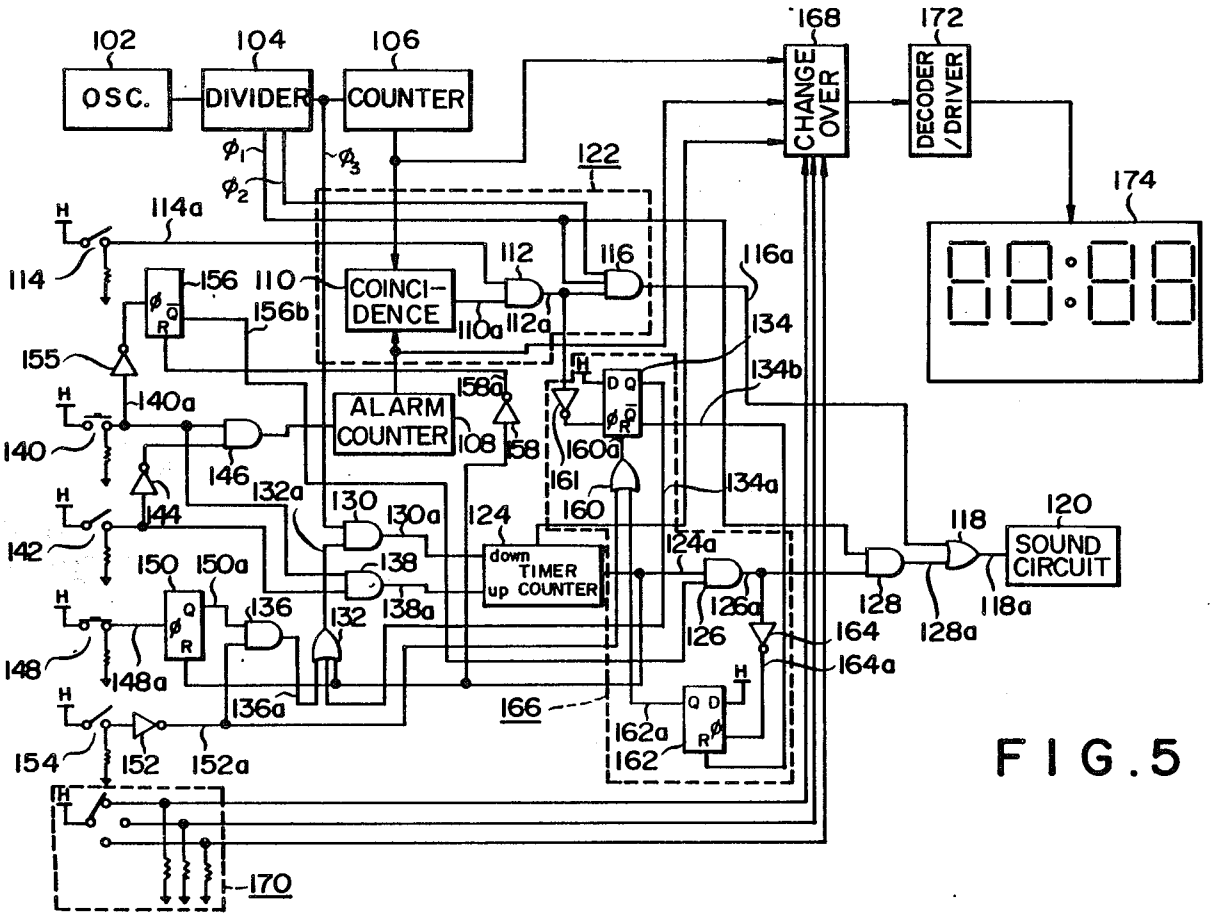
FIG. 5 is a circuit diagram in accordance with the teachings of the second embodiment.

FIG. 5 is a circuit diagram showing the second embodiment of the present invention.

In figure a standard signal generator 102 and a divider 104 output hour counting standard signal to a timing counter 106 to count the present hour. The present hour signal at the timing counter 106 is compared at an identity circuit 110 with alarming hour signal in an alarming hour counter 108 in which the alarm set hour is memorized, and identity signal 110*a* is output to an AND gate 112, if identified. The AND gate 12 is supplied sound stop signal 114*a* from a sound stop switch 114 and provides output signal to an AND gate 116. This AND gate 116 is supplied audio frequency signal $\phi_1$ and fixed periodic signal $\phi_2$ from the divider 104, and the output signal is supplied to a sound circuit 120 by way of an OR gate 118. An alarm signalling circuit 122 consists of the identity circuit 110 and the AND gates 112 and 116 to generate alarm signal at a preset hour.

Figure 6:
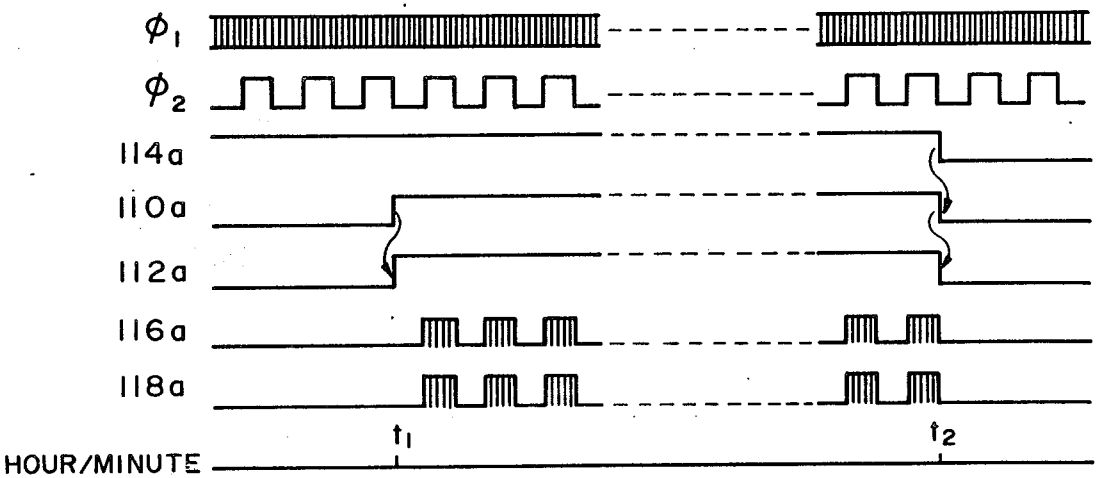
FIG. 6 is a timing chart of alarm signalling action in the circuit of FIG. 5.

FIG. 6 is a timing chart showing the action at alarm signalling time.

When the sound stop switch 114 is closed and it becomes alarm signal set hour (hour $t_1$) in the state that the sound stop signal 114*a* is H, the identity signal 110*a* rises up from L to H and the output signal 12*a* of the AND gate 112 also becomes H. Accordingly, in the output signal 116*a* from the AND gate 116 generated therein is intermittent sound signal which is superimposed the signals $\phi_1$ and $\phi_2$ thereon, and the sound signal is supplied to the sound circuit 120 by way of the OR gate 118 so that the sound circuit 120 can generate intermittent sound as the alarm signal.

Afterwards, at the hour $t_2$ when the sound stop circuit 114 is opened, the sound stop signal 114*a* becomes L to have the AND gates 112 and 116 to be closed and their output signals 112*a* and 116*a* and the output signal 118*a* of the OR gate 118 becomes L so that the signal sound is stopped being generated from the sound circuit 120.

A timer counter 124 which memorizes the set time and starts down counting when it becomes the alarm set hour consists of a up and down counter which can add and subtract. The output signal 124*a* from the timer counter 124 is provided to an AND gate 126, and the output signal 126*a* is supplied to an AND gate 128. To this AND gate 128 input is the audio frequency signal $\phi_1$ mentioned previously, and its output signal 128*a* is supplied to the sound circuit 120 by way of the OR gate 118. To the down input of the timer counter 124 provided is the output signal 130*a* from an AND gate 130, and to this AND gate 130 supplied are the fixed periodic signal $\phi_3$ and the output signal 132*a* from an OR gate 132. To this OR gate 132 input are the output from the timer counter 124, the Q output 134*a* of an FF 134 and the output 136a from the AND gate 136 which will be hereinafter described of.

On the other hand, to the up input of the timer counter 124 supplied is the output 38*a* of an AND gate 138 and to this AND gate 138 provided are correction signal 140*a* of a correction switch 140 and correction change over signal 142*a* from a correction change over switch 142. These correction signal 140*a* and correction change over signal 142*a* by way of an inverter 144 are also supplied to an AND gate 146, and the output of the AND gate 146 is provided to the alarming hour counter 108. Therefore, when the correction change over switch 142 is opened and the correction switch 140 is operated, the correction signal 140*a* is supplied to the alarming hour counter 108, and, when the correction change over switch 142 is closed and the correction switch 140 is operated, the correction signal 140*a* is provided to the timer counter 124.

Timer action signal 148*a* of a timer switch 148 which makes the timer action started or stpped is supplied to the clock input $\phi$ of an FF 150, and the Q output 150*a* of the FF 150 is provided to the one input of the AND gate 136 previously described. To this AND gate 136 input is timer contros signal 154*a* of the time control switch 154 by way of an inverter 152. Furthermore, in this embodiment, the correction switch 140 mentioned above is functioned as a timer sound stop switch and the correction signal 140*a* is supplied to the clock input $\phi$ of an FF 156 by way of an inverter 155. The $\overline{Q}$ output 156*b* of the FF 156 is provided to one input of the AND gate 126. The output 124*a* from the timer counter 124 is supplied to the reset input R of the FF 156 by way of an inverter 158.

Figure 7:
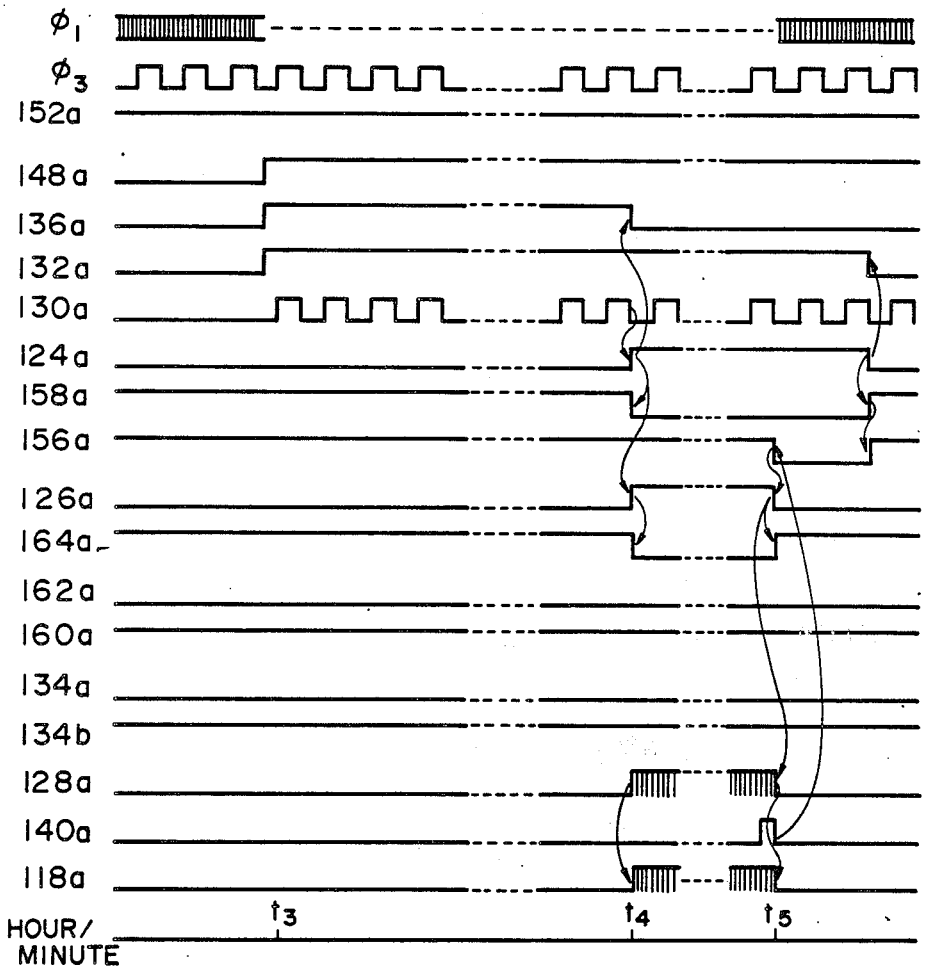
FIG. 7 is a timing chart of timer action in the circuit of FIG. 5.

FIG. 7 is a timing chart showing the timer action in the circuit of FIG. 5.

At the hour $t_3$ in the state that the set time is memorized in the timer counter 124, the operation of the timer switch 148 makes the timer action signal 148*a* rise up from L to H and the Q output 150*a* of the FF 150 becomes H. In this state, when the timer control switch 154 is open, the timer control signal 152*a* becomes H, and the output 36*a* of the AND gate 136 also becomes H. The signal of H opens the AND gate 130 so that the fixed periodic signal $\phi_3$ is supplied from the divider 104 to the down input of the timer counter 124. Therefore, the timer counter 124 starts down counting the set time.

When the set time elapses since then (hour $t_4$) the output 124*a* of the timer counter 124 rises up from L to H, and the output 126*a* of the AND gate 126 becomes H. To the output 128*a* of the AND gate 128 provided is the audio frequency signal $\phi_1$ from the divider 104 and this signal is supplied to the sound circuit 120. Consequently, the sound circuit 120 generates the continuous signalling sound which is different from the alarm signalling sound. On the other hand, when the output 124*a* of the timer counter 124 rises up from L to H, the reset state of the FF 156 is released, and the operation of the correction switch 140 at the hour $t_5$ after the signalling sound is generated makes the $\overline{Q}$ output 156*b* of the FF 156 become L and the output 126*a* of the AND gate 126 turn into L. Accordingly, the audio frequency signal $\phi_1$ is not supplied to the sound circuit 120 so that the signalling sound can be stopped.

Afterwards, at the hour $t_6$ when the output 124*a* of the timer counter 124 rises down from H to L, the FF 156 is reset and the output 156*b* becomes H.

As mentioned previously, the operation of the timer switch 148 starts the timer operation and the signalling sound is generated at the set time. When the timer switch 148 is again operated during the timer in action, the Q output 150*a* of the FF 150 is inverted into L and the AND gates 136 and 130 are closed so that the timer counter 124 stops its subtracting action.

On the other hand, the timer control signal 152*a* is supplied to the reset input R of the FF 134 by way of an OR gate 160. To the clock input $\phi$ provided is the output 112*a* of the AND gate 112 in the alarm signalling circuit 122 by way of an inverter 161. The $\overline{Q}$ output 134*b* of the FF 134 is supplied to the reset input R of an FF 162. The clock input $\phi$ of this FF 162 receives the output 126*a* of the AND gate 126 by way of an inverter 164. The Q output 162*a* of the FF 162 is supplied to the reset input R of the FF 134 by way of the OR gate 160.

These FF 134 and 162, the OR gate 160 and the inverter 164 compose a timer start circuit 166 which activates the above mentioned timer counter 124 at the hour of alarm signalling by the operation of the timer control switch 154.

Furthermore, the present hour signal from the timing counter 106, the alarming hour signal from the alarming hour counter 108 and the timer hour signal from the timer counter 124 are supplied to a display change over circuit 168. This display change over circuit 168 selects either one of the hour signals supplied by the operation of a display change over switch 170 and provides this to an hour display section 174 by way of a decoder driver 172.

Figure 8:
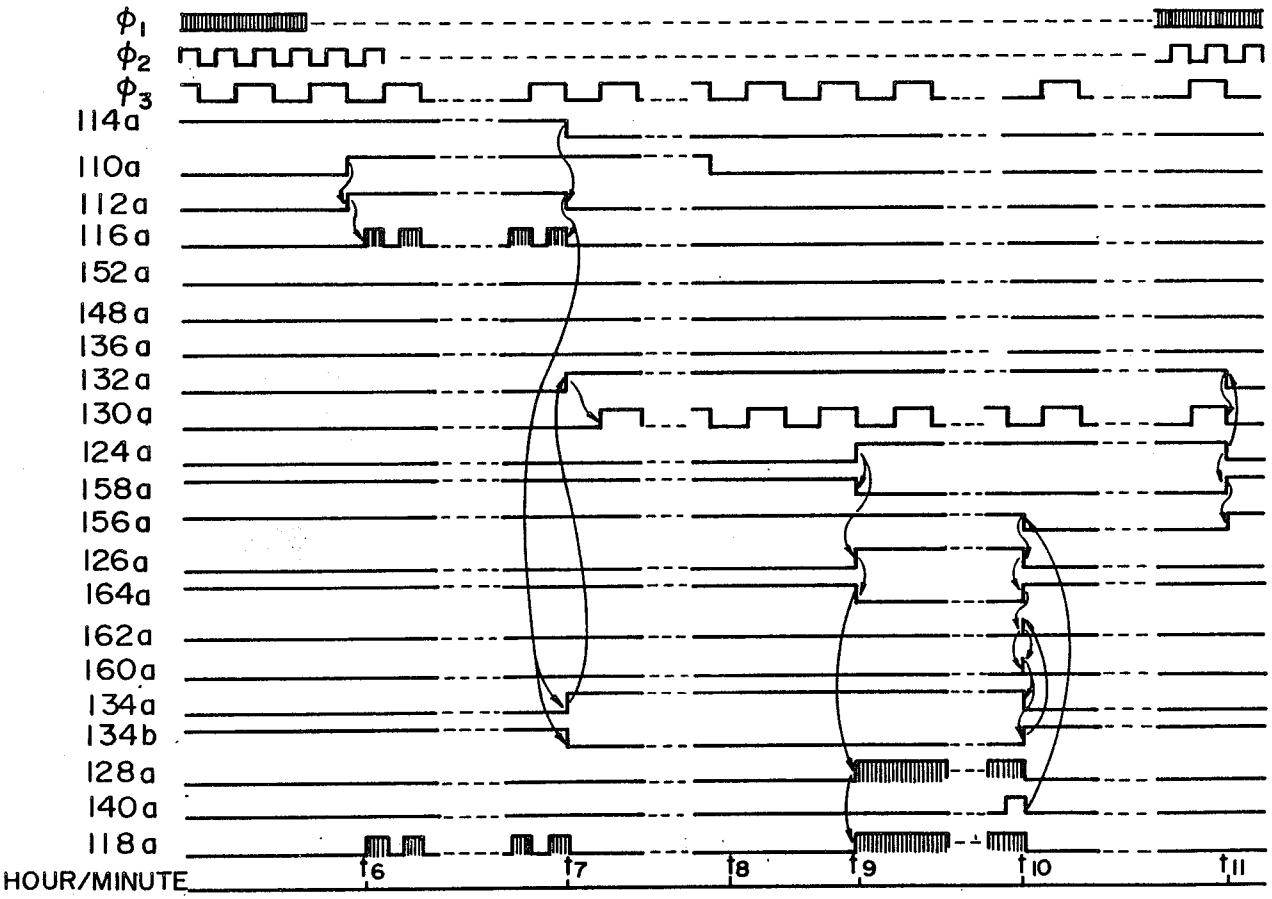
FIG. 8 is a timing chart of the action at the time of timer start in FIG. 5 after the alarm is stopped its signalling.

FIG. 8 is a timing chart showing the case that the timer is activated immediately after the alarm signalling stops, and the signalling sound is generated after the set time elapses.

In this state, both of the timer control switch 154 and the sound stop switch 114 are closed. The timer control signal 152*a* is L and the sound stop signal 114*a* is H.

Right here, at the hour $t_6$, the identity signal 110*a* becomes H, and the output 112*a* of the AND gate 112 rises up from L to H. Accordingly, the intermittent sound signal is generated in the output 116*a* of the AND gate 116, and the intermittent signalling sound is generated.

Afterwards, at the hour $t_7$ when the sound stop switch 114 is opened and the sound stop signal 114*a* becomes L, both of the output 112*a* of the AND gate 112 and the output 116*a* of the AND gate 116 becomes L, and the alarm signalling sound stops.

At the same time the output 112*a* rises down from H to L, the Q output 134*a* of the FF 134 becomes H and the output 134*b* becomes L. Therefore, since the reset state of the FF 162 is released and the H state of the output 132*a* of the OR gate 132 opens the AND gate 130, the fixed periodic signal $\phi_3$ is supplied to the down input of the timer counter 124 to start subtracting the set time.

As mentioned above, the timer starts its action at the same time the alarm signalling stops. Furthermore, at the hour $t_8$ the identity signal 110a also changes from H into L.

When it becomes the hour $t_9$ after the set time elapses from the hour $t_6$, the output 124*a* of the timer counter 124 rises up from L to H. Therefore, the output 126*a* of the AND gate 126 becomes H, and the audio frequency signal $\phi_3$ is generated in the output 128*a* of the AND gate 128. Accordingly, the timer signalling sound is generated from the sound circuit 120.

At the hour $t_{10}$, the operation of the correction switch 140 changes the $\overline{Q}$ output 156*b* of the FF 156 from H to L, and the output 126*a* of the AND gate 128 from H to L. Therefore, the output 128*a* of the AND gate 128 also becomes L, and the timer signalling sound stops.

At the same time, the clock input $\phi$ of the FF 162 receives the rising signal, and the Q output 162*a* of the FF 162 becomes H. Therefore, the output 160*a* of the OR gate 160 becomes H to reset the FF 134. The Q output 134*a* becomes L, and the $\overline{Q}$ output 134*b* becomes H. Accordingly, the FF 162 can be reset.

Furthermore, at the hour $t_{11}$, the output 124*a* of the timer counter 124 changes from H to L, and the output 132*a* of the OR gate 132 becomes L. The AND gate 130 is closed at this time, and down counting action of the timer counter 124 stops. At the same time, the FF 156 is reset and the $\overline{Q}$ output 156*a* again becomes H.

As mentioned above, when the timer control switch 154 is closed, the timer can be started at the time of the alarm signalling sound stop, and the timer signalling sound can be generated after the set time elapses. Therefore, when the clock in accordance with this embodiment is used as common alarm clock for the persons who wake up at the different hours, it becomes easier to set the other later times, since the users do not have to convert into the hour from whether the later set hour becomes so many minutes later, but can set this later time as the time is.

It is also possible in this embodiment to activate either one of the alarm signalling or the timer function.

As described heretofore, according to the present invention, the start of the timer action generating the signalling sound after the set time at the same time of alarm signalling stop enables the signalling sound to be again generated at the set time after the alarm signalling stop. Therefore, with regard to the case that the later signalling hour can be easily thought on the basis of time such as so many minutes later after the previous signalled hour, it becomes much easier to use as wake-up alarm among the persons who wakes up at the different hours than the multi-alarm signalling electronic timepiece which must be set on the basis of nothing but the hour, and the alarm signalling electronic timepiece with the timer function can be offered for the production of other various new uses.

What is claimed is:

1. An alarm signalling electronic timepiece with a timer function comprising:

an oscillator which generates an oscillating signal;

a frequency divider which divides the oscillating signal from said oscillator to produce a clock signal;

a counter which counts up in response to the clock signal form said frequency divider;

an alarming hour counter in which an alarm set hour is memorized;

an alarm signalling circuit which generates an alarm signal upon detecting the identity of the counted values of said counter and said alarming hour counter;

a first alarm circuit which generates a first alarm intermittent signal in response to the alarm signal from said alarm circuit;

a sound circuit which generates alarm sound in response to the first alarm signal sent from said first alarm circuit;

a timer counter for presetting a preset value corresponding to the preset time and counting the clock signal from said frequency divider, and for supplying the first alarm signal to said sound circuit when the counting value reaches to the preset value;

a second alarm circuit which supplies a second alarm signal which is different from said first alarm signal to said sound circuit in response to the alarm signal sent form said timer counter;

a timer switch;

a gate circuit which supplies said clock signal from said frequency divider to said timer counter upon on-operation of said timer switch;

a display change-over switch;

a display change-over circuit to which the count signals from said counter, alarm counter, and timer counter are supplied and which outputs alternatively any one of these count signals in response to the operation of said display change-over switch;

a display circuit which displays the count signal from said display change-over circuit;

a timer start circuit which outputs a timer start signal for supplying the clock signal from said frequency divider to the timer counter when a change of the alarm signal from the alarm circuit is detected and for holding the gate circuit opened until the output of the alarm signal from said timer counter stops;

a timer control switch; and a timer starting circuit which determines whether to supply the signal from the timer start switch to said gate circuit while stopping the output of the timer start signal from said timer start circuit or to supply the timer start signal from said timer start circuit to the gate circuit while stopping the signal from said timer start switch in response to the operation of the timer control switch.

2. An alarm signalling electronic timepiece with a timer function according to claim 1, wherein said timer start circuit holds the time present in said time counter until the alarm signal is generated from the alarm signalling circuit, and start counting in said timer counter when the alarm signal is generated.

3. An alarm signalling electronic timepiece with a timer function according to claim 1, wherein said timer start circuit holds the time present in said timer counter until the alarm signal generated from the alarm signalling circuit terminates, and starts counting in said timer counter when the alarm signal terminates.

* * * * *